United States Patent [19]

Sheltra, Sr.

[11] 4,220,234

[45] Sep. 2, 1980

[54] SUPPLEMENTAL COIN ACCEPTOR/REJECTOR MECHANISM FOR COIN OPERATED MACHINES

[76] Inventor: Russell G. Sheltra, Sr., 14101 Mt. Charleston, Reno, Nev. 89507

[21] Appl. No.: 22,135

[22] Filed: Mar. 20, 1979

[51] Int. Cl.[3] ..... G07F 5/16

[52] U.S. Cl. ..... 194/1 G; 133/3 C; 194/1 K; 194/1 L; 194/102

[58] Field of Search ..... 194/99, 102, 1 K, 1 L, 194/1 G, DIG. 2, DIG. 20; 133/3 R, 3 C, 3 D

[56] References Cited

U.S. PATENT DOCUMENTS

| | | | |
|---|---|---|---|
| 2,744,603 | 5/1956 | Haverstick | 194/102 |
| 2,806,573 | 9/1957 | Marcuson | 194/DIG. 2 |
| 2,880,836 | 4/1959 | Stewart | 194/102 |

*Primary Examiner*—F. J. Bartuska
*Attorney, Agent, or Firm*—Sughrue, Rothwell, Mion, Zinn and Macpeak

[57] ABSTRACT

A coin operated machine, such as a vending machine including a first coin acceptor/rejector mechanism which normally separates acceptable coins from non-acceptable coins, also carries an underlying mechanism which includes a pivotable chute positioned in the path of the rejected coins and having an opening sized to receive rejected same value, but different size and weight, coins of a predetermined diameter and smaller size coins. The chute bears a coin reject window for causing coins smaller than those of said predetermined diameter to be rejected from the chute and further includes an inclined on-edge coin gravity flow path of a predetermined angle to horizontal. A microswitch feeler along said path senses passage of said same value coins and the chute segregates these coins from the other rejected coins. The chute is automatically pivoted between gate open and gate closed positions in response to this microswitch and another microswitch sensing acceptance of a predetermined number of proper value coins of different size and weight to insure return of superfluous coins to the operator, in any sequence.

5 Claims, 6 Drawing Figures

FIG. 5
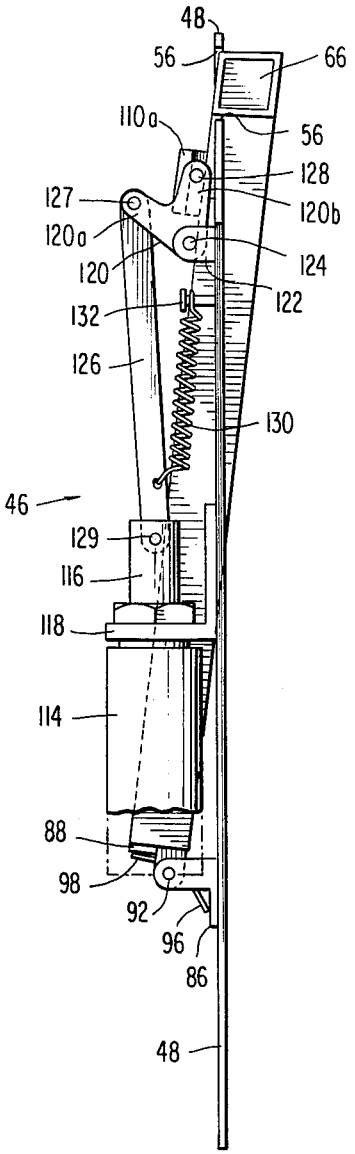
FIG. 3a
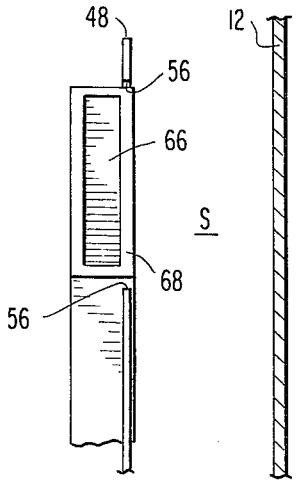
FIG. 3b
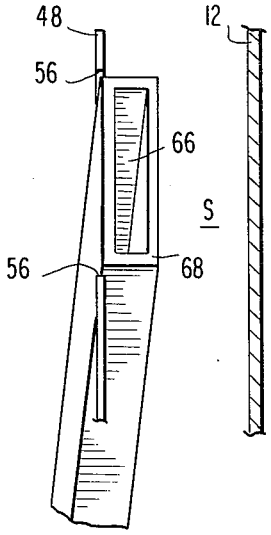
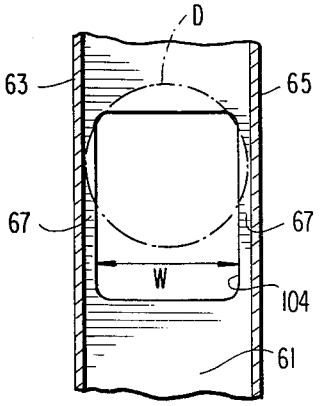
FIG. 4

SUPPLEMENTAL COIN ACCEPTOR/REJECTOR MECHANISM FOR COIN OPERATED MACHINES

FIELD OF THE INVENTION

This invention relates to coin operated machines such as a vending machine which operate upon acceptance of suitable coins of given value and, more particularly, to an auxilliary coin acceptor mechanism for permitting machine operation to occur by acceptance of single selected equal value previously rejected coins as well as normally accepted like value coins.

BACKGROUND OF THE INVENTION

Coin operated machines such as vending machines permit automatically the dispensing of items purchased normally fed by gravity through discharge chutes as a result of prior receipt of one or more coins acceptable to the mechanism. Since such machines are subject to fraud by use of metallic slugs, that is, coin sized discs which are in fact counterfeit, and since such mechanisms require some selectivity, some type of acceptor/rejector mechanism is included in the machines for accepting coins only of predetermined diameter, weight, monetary value and the like. It is conventional to provide such machines with a mechanism which senses certain properties of the coins and permits the machine to dispense the article or to reject the coins without dispensing an article based on a determination as best possible of the acceptability of the coins being fed to the machine.

One type of coin acceptor/rejector mechanism commonly employed is a pivotable, floatng tumbler which is supported for pivoting or rotation about a horizontal axis and lying beneath the discharge opening of an inclined chute which bears an on-edge coin as received from a coin receiver opening within the machine casing. The coin in dropping by gravity from the chute and onto the floating tumbler either passes between spaced projections or prongs on the floating tumbler when constituting an undersized coin, that is, one whose diameter is less than the distance between the projections on the floating tumbler or, alternatively, if the coin is properly sized, in contacting the prongs, the floating tumbler is deflected or rotated about its axis to physically throw the deposited coin laterally to one side of the floating tumbler, and to the side of the first coin reject discharge path which permits undersized coins to pass between the prongs, for movement along a second accept discharge path into a hopper or similar container positioned to receive acceptable coins. In order to permit the machine to operate, for instance, to dispense the article upon receipt of a proper number of acceptable coins, a microswitch or other sensor may be positioned in the second discharge path for the accepted coins leading to the hopper. The microswitch is weight operated by the acceptable coin and providing an electrical pulse count for each acceptable coin passing therethrough. When the number of pulses or counts as stored by a counter or similar storage mechanism reaches a predetermined acceptable value, the machine functions to release a stored article, thus dispensing the article to the customer. The other coins are normally returned to the exterior of the casing of the coin operated mechanism and fall into a customer tray. While such mechanisms are capable of accepting a single permitted coin or one having similar weight, diameter, thickness and other properties or characteristics, the mechanisms to date have no capacity for sensing a second coin of equal value but of different diameter, thickness and weight.

It is, therefore, a primary object of the present invention to provide an improved supplemental coin acceptor/rejector mechanism which may be readily mounted to an existing coin operated vending machine or the like and which will permit the machine to operate correctly and dispense the article upon receipt of a given number of normally acceptable coins or alternately acceptable coins as for instance of same value but of different size and weight.

It is a further object of this invention to provide such supplemental coin acceptor/rejector mechanism which automatically counts the number of same value different sizes coins received by the dispensing mechanism and causes automatic return to the machine operator of superfluous coins fed to the machine in numbers in excess of those required to properly operate the machine.

SUMMARY OF THE INVENTION

The supplemental coin acceptor/rejector mechanism for a coin operated vending machine or the like comprises a device which is mounted to an existing coin operated machine. The machine may include a coin receiver mounted within the machine casing and leading from the casing coin receiver opening to a first coin acceptor/rejector mechanism. A customer tray opening to the machine casing exterior lies below the first coin acceptor/rejector mechanism and permits return of non-accepted coins. A coin acceptor/rejector member positioned in the path of the coins entering the machine through the coin receiver opening act to separate normally acceptable coins from non-acceptable coins and for feeding said coins respectively along a normal acceptable coin discharge path and a rejected coin discharge path. The improvement resides in an auxilliary acceptor/rejector mechanism positioned in the path of the rejected coins. The auxilliary acceptor/rejector mechanism comprises a pivotable chute having an opening facing said rejected coins and sized to receive rejected coins which are of the same value but different size and weight from the normally accepted coins and the coins of a diameter smaller than said coins of same value but different size and weight. The chute forms a gravity on-edge coin flow path for the rejected coins received through the opening. A coin reject window lies within the chute. Means are provided for causing coins smaller in diameter than the same value different size and weight coins to be rejected from the chute through the window. The chute includes an inclined, coin on-edge gravity flow path of a perdetermined angle to the horizontal. Means are mounted along the inclined flow path for sensing the passage of the same value different sized coins downstream of said window. Means in response to the passage of predetermined numbers of the same value different size and weight coins past the coin sensor are provided, for shifting the chute relative to the discharge path for rejected coins from the first coin acceptor/rejector mechanism to cause any additional coins fed to the machine through the coin receiver opening to pass to the customer's tray for return to the customer.

Preferably, the pivotable chute is pivotably mounted at a lower edge below the first coin acceptor/rejector mechanism and includes a portion which extends upwardly from that edge towards the rejected coin discharge path. The mechanism further comprises a solenoid operatively coupled to the discharge chute such that energization of the solenoid causes the chute to pivot about its lower edge such that the chute opening is laterally displaced relative to the discharge path for rejected coins from a position intersecting that path to one laterally displaced therefrom. The mechanism further comprises spring biasing means for spring biasing the chute into a position with the chute opening aligned with the rejected coin discharge path.

The chute may be generally L-shaped in elevation including generally right angle legs, the first leg of which is inclined upwardly form its apex towards the rejected coin discharge path and the second leg is inclined downwardly at the predetermined angle to the horizontal. The microswitch preferably comprises a metal wire feeler extending across the path of the coin moving along the inclined gravity flow path as defined by the second leg as performed by the second leg, such that the same value, different size coins by their weight and diameter cause the feeler to be deflected from a normally blocking position to an unblocking position to permit the coin to be discharged from the lower end of the chute. The microswitch includes normally open contacts which are momentarily closed by deflection of the feeler due to passage of a same value different size and weight coin.

BRIEF DESCRIPTION OF THE DRAWINGS

FIG. 3*a* is a perspective view of a portion of the mechanism of FIGS. 1 and 2 with the chute in gate open position.

FIG. 3*b* is a similar perspective view to that of FIG. 3*a* with the chute in gate closed position.

FIG. 4 is a sectional view of a portion of the chute and the underlying coin discharge window of the mechanism shown in FIGS. 1 and 2.

FIG. 5 is an end elevational view of the mechanism of FIGS. 1 and 2.

DESCRIPTION OF THE PREFERRED EMBODIMENT

Figure 1:
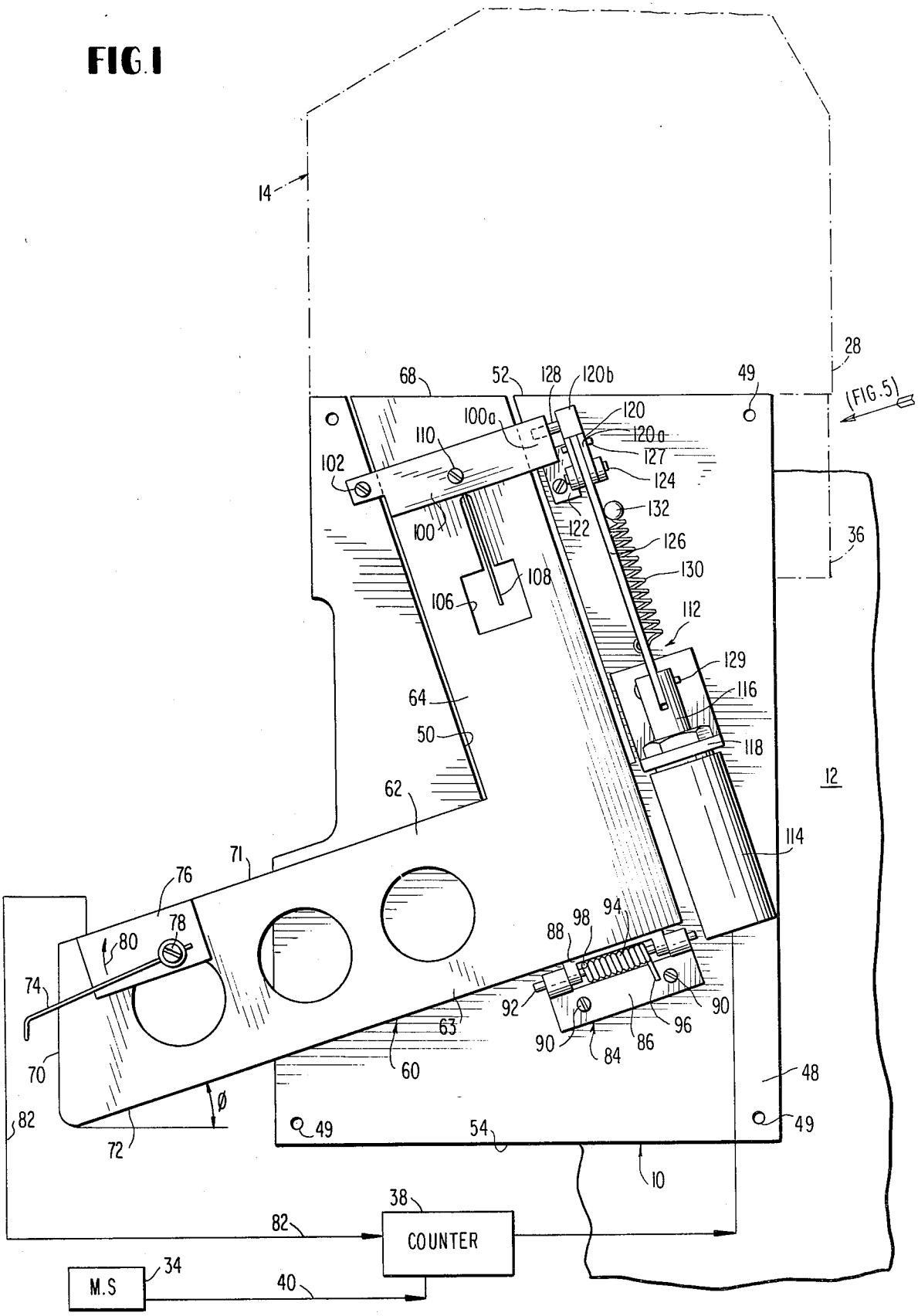
FIG. 1 is a front elevational view of the supplemental coin acceptor/rejector mechanism within a coin operated machine and forming one embodiment of the invention.
Figure 2:
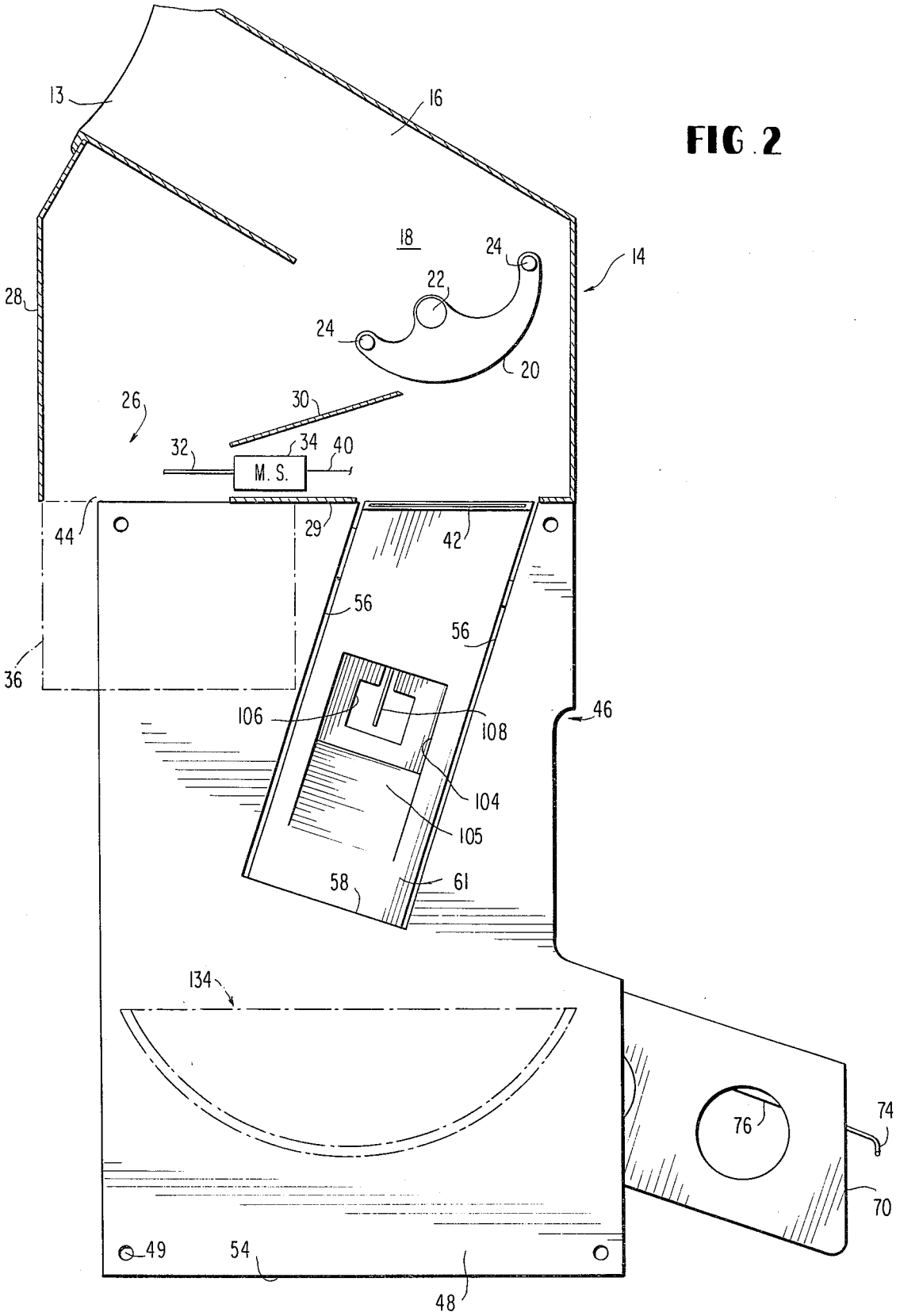
FIG. 2 is a rear elevational view of the mechanism of FIG. 1.

The supplemental coin acceptor/rejector mechanism or device of the present invention is indicated generally at 10. The mechanism or device 10 is adapted for mounting to the rear side or back of a pivotable or otherwise openable vertical door indicated generally at 12 of a coin operated machine, otherwise not shown, and underlies the coin receiver within the machine as well as a first coin acceptor/rejector mechanism conventionally employed in accepting only one given value coin for operation of the vending machine or the like, while rejecting all other coins. In that respect, a coin receiving opening 13, which may be in the door 12, leads to a coin receiver 16 which directs on-edge coins to the first or principal coin acceptor/rejector mechanism indicated generally at 14. The receiver 16 terminates at its lower end in an opening 18 which overlies a floating tumbler 20 which is crescent shaped, formed of metal, and mounted between its ends for pivoting about a horizontal axis by way of a pivot pin 22 which projects at right angles to the plane of the door and may be fixed thereto. The crescent shaped floating tumbler 20 bears a pair of projecting prongs or similar protuberances as at 24 which are spaced a distance between each other which is determined on the basis of the diameter of a normally acceptable coin having given monetary value, thickness, weight and diameter. For instance, the acceptable coin may be a U.S. minted silver dollar which is of a diameter such that as it falls from the opening 18 at the lower end of the receiver 16 leading from the coin receiver opening slot 13 within the door, will be prevented from passing between those projecting prongs. In fact, the impact of the silver dollar on the prongs 24 causes the floating tumbler to pivot counterclockwise, FIG. 2. Physically, the silver dollar, which is the normally acceptable coin in this case, will be thrown to the left, where it falls by gravity along an accept discharge path 26 defined by an end wall 28 and an adjacent inclined wall 30, and through accept discharge opening 44 formed with lower wall 29, and ride over a feeler 32 carried by a first microswitch 34. The normally acceptable coins or silver dollars are received within a hopper indicated schematically at 36 which receives and stores the normally acceptable coins. The microswitch 34 is conventional and comprises normally open contacts which are closed by movement of the feeler 32 upon deflection to permit the normally acceptable coin to fall into the hopper. The microswitch provides an electrical pulse which is fed to a counter indicated in block form at 38, FIG. 1, via line 40, where the count may be stored. The counter 38, and the storage of pulse counts, and the first coin acceptor/rejector mechanism 14 are conventional in certain types of coin operated machines.

Alternatively, should inserted coins be smaller in size than the normally acceptable coin, that is, the silver dollar, as for instance a half dollar, a quarter, a dime or the like, such coins simply pass by gravity through the opening between the projections or prongs 24 on the floating tumbler 20 and continue along a reject discharge path including coin acceptor/rejector mechanism, reject discharge slot 42 which is in line with the opening 18 leading from the receiver 16. The accept discharge opening 44 is laterally spaced from the reject discharge opening 42 with the primary coin acceptor/rejector mechanism. The first opening 44 within wall 29 leads from mechanism 14 to hopper 36 and permits accumulation of the normally acceptable coins, in this case the silver dollars, within the machine.

The present invention is directed to a supplemental coin acceptor/rejector mechanism indicated generally at 46 which is also preferably mounted to the rear of the door 12 forming a part of the casing and opening to the interior of the machine. The supplemental coin acceptor/rejector mechanism or device 46 is comprised of a base plate 48 which is generally of modified rectangular plan configuration and includes several mounting holes as at 49 permitting mounting screws or bolts to fix the base plate 48 vertically against the rear wall of a vertical door 12; the screws preferably maintaining the plate 48 are spaced several inches from the rear of the door so as to permit coins to pass downwardly with space S between the base plate 48 and the rear of the door 12, internally of the vending machine. The plate 48 bears an oblique rectangular slot 50 which extends downwardly from its upper edge 52 and terminates short of the lower edge 54 of plate 48. The slot 50 is characterized by opposed parallel side edges 56 and a bottom edge 58. The slot 50 is purposely angulated or oblique to the horizontal and vertical and acts to normally receive the upper end of leg 64 of an L-shaped chute 60 comprised of right angle legs 62 and 64. The chute 60 is essentially a hollow member having an internal passage which is rectangular in cross-section for both legs and consists of opposed, spaced side walls 61, 63 joined by opposed end walls 71, 72. The side walls 61, 63 are separated by a distance which is in excess of the thickness of a same value different size and weight coin which selectively passes through the chute 60 as permitted by the normal operation of this mechanism.

The chute 60 is provided with a rectangular opening 66 at the upper edge 68 of leg 64 which is oblique with respect to this leg but which is flush with the upper edge 52 of the base plate 48. The chute leg 64 could rise to a level above the base plate 48 but should have its upper edge 68 essentially horizontal so as to accept the coins which drop under gravity influence from the area of the floating tumbler 20 and through the coin reject discharge slot 42 within the primary coin acceptor/rejector mechanism 14.

Additionally, the L-shaped chute side walls 61, 63 for both legs 62 and 64 are of a width which is in excess of the diameter of the same value different size coin to be received and transported by this element. With respect to leg 62, the side walls 61, 63 are joined at the bottom of leg 62 by a transverse end wall 72 which forms an inclined ramp or surface upon which coins falling into the upper leg 64 roll, towards discharge opening 70 at the lower end of this leg 62. The inclined slot 50 is formed at an angle which is at 90° to the angle of inclination of the ramp 72, ramp 72 being at an angle $\phi$, FIG. 1, which is determined to be 18° in this case, permitting the desired passage of the equal value coin past a microswitch feeler 74 which projects outwardly from the side of a second microswitch 76, which is mounted to the exterior sidewall 63 of the L-shaped chute 60. The microswitch 76 bears a rotatable actuator 78 which has one end projecting outwardly of the side of the casing of that switch. The feeler 74 constitutes a thin steel wire or the like, projects along the side of the microswitch 76, and is bent at its end remote from the actuator 78 to span across the discharge opening 70 of chute 60. The feeler 74 is bent and oriented such that it lies normally in the path of the same value, different size and weight coins as they roll down the ramp 72 and discharge through discharge opening 70. The weight of the coin and its diameter are coordinated to the position of the feeler 74 so that the feeler 74 is rotated clockwise as indicated by arrow 80 to the extent where the state of the microswitch contacts change. The closing of contacts (not shown) internally of microswitch 76 creates an electrical pulse which is fed by line 82 to the counter 38, which also receives pulses from microswitch 34 through line 40. The L-shaped chute 60 is hinge mounted to the side of plate 48 and spaced slightly therefrom by way of a spring biased hinge 84. The hinge 84 comprises two hinge plates, a first plate 86 which is screwed by way of screws 90 to the side of the plate 48 on the same angle as the angle $\phi$ and a second plate 88 is fixed to the bottom of the ramp 72 spanning between the two side walls partially forming chute 60.

The hinge includes a hinge pin 92 which pivotably connects the plates together and which bears a coil spring 94 having ends as at 96 and 98 bearing on respective plates and tending to force the hinge plates 86 and 88 apart, thereby tending to rotate the chute 60 in the direction of the back of the mounting plate 48 and towards the door 12 which is spaced slightly from the mounting plate. Thus, the upper leg 64 tends to project through the slot 50 into space S under the bias of coil spring 94. The mechanism of the present invention requires close control of the position of the chute, the movement of the coins within the chute, and the sensing of the coins for proper weight, diameter and the like.

Since the upper leg 64 of the chute 60 is longer than the slot 50 which receives the same, the bottom edge 58 of that slot acts as a stop to restrict pivotable movement of the chute 60 under bias of spring 94. Further, since the hinge 84 maintains the bottom of the chute 60 spaced slightly from the front of plate 48, the opening 66 in the upper edge 68 of the chute leg 64 will lie within space S between the base plate 48 and the door 12 to which it is mounted. This may be best seen in FIG. **3*b* where the gate is closed, that is, the upper end 68 of the chute 60 projects into the space S between the plate 48 and the door 12. Since the gravity flow path for the coins which are not accepted by the primary or first acceptor/rejector mechanism 14 is defined by the aligned openings or slots 18 and 42, it is important that the opening 66 within the upper end 68 of the chute be properly positioned with respect to this flow path. When intersecting the flow path, it accepts coins of varying sizes having a diameter not in excess of that of the same value different size coins being monitored by the auxilliary acceptor/rejector 46 of the present invention. To facilitate the movement between gate open and gate closed positions as per FIGS. 3*a* and 3*b*, a spring retainer plate 100 is screwed or otherwise affixed to the outer surface of the side wall defining chute 60 facing away from the base plate 48, this spring retainer plate 100 being of a width in excess to that of the slot 50 through which the upper leg 64 of the chute tends to project under the bias of the coil spring 94. While this spring retainer plate 100 also tends to restrict pivotable movement and prevent the upper leg 64 from projecting too far into the space as between the base plate and the door, the spring retainer plate preferably carries an alignment screw 102 which is threaded to the spring retainer plate 100, to one side of slot 50, such that the end of the screw contacts the base plate 48. By adjusting the screw, the extent of pivotable movement into space S by the upper end 68 of the chute 60** is precisely set.

As mentioned previously, the function of the auxilliary coin selector/rejector mechanism is to selectively sort or separate an alternately acceptable coin, that is, one preferably having the same value but of different size, and segregate this coin from all other non-acceptable or rejected coins. For purposes of illustration and assuming that the primary acceptable coin is the U.S. minted silver dollar, the same value different sized coins may be a U.S. minted Susan B. Anthony silver dollar which is of a different thickness and different diameter as well as obviously different weight. As a matter of fact, the U.S. minted silver dollar of larger size is 22.9 grams in weight, while the Susan B. Anthony silver dollar is 8.8 grams. The diameter of the two coins is substantially different, and the Susan B. Anthony coin determines the width of an elongated generally rectangular opening 66 with side wall 61 of the chute 60 and the path of that coin through the chute 60. As may be seen by reference to FIG. 4, being a longitudinal sectional view of a portion of leg 64 of chute 60, the opposed end walls 63 and 65 of that leg are spaced a distance which is slightly greater than the diameter of a Susan B. Anthony silver dollar D, shown in this figure as resting upon a pair of opposed rails 67 formed by cutting the narrower width coin discharge window 104 within the chute side wall 61. The window width W determines the diameter of coins which may be forced out of the upper chute leg 64 during gravity movement after entering opening 66 within the upper end 68 of this chute. To facilitate forced movement of the coin through the window 104 which faces the space S and therefore the inside of the door 12 upon which the device is mounted, the opposite side wall 63 of the chute 60 in this area bears a smaller size opening or window 106 through which projects a wire spring 108, one end of which is fixed to the transversely extending spring retaining plate 100 and maintained in proper position by a set screw 110. The spring 108 projects diagonally through window 106 towards the much larger reject coin discharge window 104, in the path of coins falling downwardly within chute 60. Thus, since the window has a width W which is smaller than the diameter of the Susan B. Anthony silver dollar D, the window at this point forms opposed rails as at 67, upon which the peripheral edges of the Susan B. Anthony silver dollar D rest, being pressed against those rails during transport by the thin spring wire 108. Whenever a coin having a diameter smaller than the distance W between the sides of the window 104 reaches this point in its path of movement, it is forced through the window 104 and falls into the space S between the base plate 48 and the door 12 to which it is mounted.

As mentioned previously, the mechanism of the instant invention has a selectivity feature, that is, it is permitted to move from gate open position to gate closed position under the bias of spring 24, but is forcibly shifted from gate closed position, FIG. 3*b*, to gate open position, FIG. 3*a*, by energization of a solenoid operated mechanism indicated generally at 112. This mechanism, FIG. 5, comprises a solenoid 114 which is fixedly mounted adjacent to chute 60. The solenoid 114 includes a plunger 116 which projects outwardly from one end 118 of the solenoid. A bell crank member 120 is pivotably mounted to the base plate 48 by means of a bracket 122 and pin 124 for pivoting about a horizontal axis at its apex. The bell crank member 120 has two arms, a first arm 120*a* whose outboard end is pin connected by pin 127 to an operating lever 126 which in turn is pin connected by pin 129 to plunger 116. The other arm 120*b* of the bell crank member bears a pin 128 which projects laterally to the side of that arm and which underlies a recessed portion of one projecting end 100*a* of the spring retainer plate 100. The end 100*a* of the spring retainer plate 100 extends beyond edge 56 of slot 50, such that when the solenoid 114 is energized and the plunger 116 retracts (against the bias of a coil spring 130 which is fixed to the lever 112 at one end and fixed to a pin 132 projecting outwardly of the base plate 48 at its opposite end) and the pin 128 borne by the bell crank member forces the chute 60 to pivot against the bias of coil spring 94 from a first gate closed position, FIG. 3*b*, to a second gate open position, FIG. 3*a*. The upper end 68 of the chute 60 thus moves from the gate closed position, that is, to the right of the base plate 48, FIG. 3*b*, to a position where it is essentially to the left, in gate open position, FIG. 3*a*. Coil spring 130 provides a positive bias acting on the plunger 116 to keep it in projected position to overcome any possibility of residual magnetism tending to maintain the plunger 116 axially in retracted position and inadvertently maintain the chute in gate open position when it should be in gate closed position.

By means of counter 38, it is possible to closely control the positioning of the chute and the movement between gate open and gate closed position and vice versa. For instance, the instant supplemental coin acceptor/rejector mechanism permits the machine to accept alternatively same value coins having different sizes and different weights, as for instance permitting the machine to accept large size silver dollars and Susan B. Anthony silver dollars D but rejecting all other coins. Since the machine will perform a given function after receipt of a sufficient number of same value coins whether they be the same size or different size, it is important that the microswitch 76 and its pulse count be coordinated with action of the microswitch 34 and its pulse count, both connected to the counter 38 and being operable in this case to control the solenoid 114 in receipt of a signal indicating the acceptance by the machine of a predetermined number of acceptable coins, be they U.S. minted large size silver dollars of 22.5 grams or the Susan B. Anthony dollars D of 8.8 grams, as an example.

Further, it is a function of the instant invention to provide for the return to the vendee of any coins in excess of the amount needed to produce the desired action or operation of the machine, be it vending or otherwise. As mentioned previously, the machine bears a customer tray indicated in dotted line at 134 which may actually be formed into the bottom of the door of the vending machine and permitting the rejected coins after passage through the accept/reject mechanism 14 and the accept/reject mechanism 46 of the present invention to enter that tray with the tray being partially open to the machine exterior and preferably through the door to permit the customer to remove non-accepted coins. The upper end 68 of the chute into the portion of the space S between the base plate 48 and the door 12 physically blocks the path of coins which are rejected by the floating tumbler 20 and assuming that the coins are not same value different size coins such as the Susan B. Anthony dollars D, they will be rejected by discharging through the coin discharge window 104 within the side wall 61 of the chute 60, while passing through the upper leg 64 of that member. Since the upper end of the chute 60 is inclined to the extent that the window is generally to the right of the base plate 48, FIG. 3*b*, these coins will continue to fall in generally the same path as they would with the chute in the gate open position, FIG. 3*a*. As a matter of fact, by reference to FIG. 2, it may be seen that beneath the window 104, within the sidewall 61, there is an inclined ramp 105, whereby the rejected coins of a diameter small enough to pass through the window 104 slide downwardly on the ramp 105 for further discharge by gravity into the customer tray 134.

Some types vending or other purpose coin operated machines to which the invention is applicable are equipped with means (not shown) for rendering the floating tumbler inoperative upon receipt of a specified number of acceptable coins. For instance, assuming that the machine is a vending machine and will vend upon receipt of three dollar coins, prior to the present invention a machine not equipped with the mechanism of the present invention, will cause the microswitch 34 to initiate three pulses upon passage of the acceptable coins through the coin accept discharge slot or opening 44 by way of feeler 32 which pulses are fed to the counter 38 by way of line 40. By means (not shown) any attempt to add further coins which result in the modification of the machine to the extent that a fourth silver dollar will simply be returned to the vendee by causing it to pass unimpeded to the customer tray 134. The present invention advantageously supplies additional pulses by way of line 82 to the counter 38, such that upon receipt of a desired predetermined number of pulses indicative of the acceptance of a predetermined number of acceptable coins by either mechanism 14 or 46, there results the energization of the solenoid 114 and the movement of the chute from the gate closed to the gate open position, automatically insuring the return to the vendee via customer tray 134, of any additional submitted coins whether they be acceptable coins or non-acceptable coins.

It may be appreciated that various modifications may be made. For instance, while the chute 60 is shown as being comprised of two right angle legs 62 and 64, it is possible that leg 64 may be eliminated and the opening 66 be provided at the upper edge of one end of a single leb 62, that is, at the right end of the ramp 72, in which case the coin accepted by this supplemental coin acceptor/rejector mechanism chute rolls down an inclined chute portion past the microswitch feeler 74 but in which case the action is the same. The chute would be required to be pivoted between gate closed and gate open positions and vice versa in the same manner but without the need for an elongated leg as at 64. The coin discharge or reject window 104, in this case, would be provided within the single leg 62 of the chute rather than in a leg separate from that bearing the microswitch 76.

While the invention has been particularly shown and described with reference to a preferred embodiment thereof, it will be understood by those skilled in the art that various changes in form and details may be made therein without departing from the spirit and scope of the invention.

What is claimed is:

1. A supplemental coin acceptor/rejector mechanism for a coin operated vending machine or the like, said machine comprising:

a machine casing, a first coin acceptor/rejector mechanism, a coin receiver opening within said machine casing, a coin receiver leading from said casing coin receiver opening to said first coin acceptor/rejector mechanism, a customer tray within said casing, below said first coin acceptor/rejector mechanism and opening to the machine exterior to permit return to the vendee of non-accepted coins passing through said first coin acceptor/rejector mechanism from said coin receiver, a coin acceptor/rejector member within said first coin acceptor/rejector mechanism and positioned in the path of coins entering said coin acceptor/rejector mechanism through an opening therein, from said coin receiver and acting to separate normally acceptable coins from non-acceptable coins and for discharge of coins respectively along laterally spaced, coin accept discharge and coin reject discharge paths, said coin discharge path leading to said customer tray;

the improvement comprising:

a supplemental coin acceptor/rejector mechanism operatively positioned in the coin reject discharge path and between said first coin acceptor/rejector mechanism and said customer tray, said mechanism comprising a shiftable chute having an opening sized to receive rejected coins which are of the same value but different size and weight from the normally accepted coins and smaller diameter coins and forming a gravity flow on-edge coin path for the rejected coins received through said chute opening, a coin reject window within said chute, means for causing coins smaller in diameter than said same value, different size and weight coins to be rejected from the chute through said window and for passage to said customer tray, said chute further including means sensing the passage of said same value, different sized and different weight coins through said chute, downstream of said coin reject window, and means responsive to operation of said sensing means for shifting said chute between a first position where said chute opening is in line with the discharge path for rejected coins from the first coin acceptor/rejector mechanism to a second position where said chute opening lies outside of said path, and wherein said rejected coins from said first coin acceptor/rejector mechanism pass directly to said customer tray.

2. The supplemental coin acceptor/rejector mechanism as claimed in claim 1, wherein said chute comprises opposed side walls and opposed end walls defining a rectangular cross-sectional space having a width in excess of the thickness of said same value different size and different weight coins and having a length slightly in excess of the diameter of said same value different size different weight coins, and wherein said window comprises an opening within one of said side walls having a lateral width slightly less than the diameter of said same value different size different weight coins such that undersized coins may pass therethrough, and said mechanism further comprises a spring extending into the interior of said chute and contacting the side of the coin opposite said window for forcing said undersized coins through said window.

3. The supplemental coin acceptor/rejector mechanism as claimed in claim 2, wherein said mechanism comprises a base plate extending vertically within said machine and being fixedly mounted inside of said machine, said chute is hinge mounted to said base plate such that one of said end walls is inclined at a predetermined angle with respect to the horizontal such that the on-edge coin rolls on said end wall by gravity, said chute includes a discharge opening at the lower end of said inclined end wall, said mechanism further comprises a microswitch mounted to said chute and having a microswitch feeler mounted thereto for changing the state of said microswitch, said feeler including a portion projecting across the discharge opening of said chute and in the path of said same value different size and different weight coins and being shiftable in response to rolling movement of said coins along said chute end wall so as to change the state of said microswitch, counter means for counting electrical pulses emanating from said microswitch in response to a change of state, and means responsive to a predtermined count by said counter for shifting said chute between said first and said second positions.

4. The supplemental coin acceptor/rejector mechanism as claimed in claim 3, wherein said base plate comprises a slot, said pivotable chute includes a portion which is movable through said base plate slot such that said portion of said chute bearing said opening is shiftable from one side of said base plate to the other between said first position and said second position and vice versa, spring biased hinge means pivotably mounting said chute to said base plate, and a solenoid mounted to said base plate and operatively connected to said counter upon energization in response to a predetermined count of same value different size different weight coins passing said sensing means of said chute causes shifting said chute from said first position to said second position against said spring bias to insure return of all excess coins regardless of value to said machine operator.

5. The supplemental coin acceptor/rejector mechanism as claimed in claim 4, wherein said base plate slot is a diagonal slot, said chute is L-shaped in configuration including right angle, upper and lower legs, said L-shaped chute is spring hinged at a lower leg to said base plate for pivoting about an axis which is inclined slightly to the horizontal and the upper leg of said L-shaped chute is projectable into and out of said slot such that the open upper end of said upper leg is selectively positioned to either side of said base plate, said spring biasing means biases said upper leg into said first position on one side of said base plate and a pivotable bell crank connected to said solenoid bears means which operatively contacts said chute upper leg to force the upper end of said leg to shift from said one side of said base plate to the other in response to energization of said solenoid.

* * * * *